US006832746B2

(12) United States Patent
McCracken et al.

(10) Patent No.: US 6,832,746 B2
(45) Date of Patent: Dec. 21, 2004

(54) ATTACHMENT DEVICE FOR CONCRETE SHORING APPARATUS

(75) Inventors: Robert Glen McCracken, Urbandale, IA (US); John Michael King, Des Moines, IA (US)

(73) Assignee: Wilian Holding Company, Des Moines, IA (US)

( * ) Notice: Subject to any disclaimer, the term of this patent is extended or adjusted under 35 U.S.C. 154(b) by 0 days.

(21) Appl. No.: 09/927,432

(22) Filed: Aug. 10, 2001

(65) Prior Publication Data

US 2003/0029988 A1 Feb. 13, 2003

(51) Int. Cl.[7] ..... E04G 25/00
(52) U.S. Cl. ..... 248/357; 52/126.6
(58) Field of Search ..... 248/357; 52/126.1, 52/126.5, 126.6; 254/100, 101

(56) References Cited

U.S. PATENT DOCUMENTS 1,528,034 A * 3/1925 Thielmann ..... 248/357
1,825,912 A * 10/1931 Markham ..... 248/357
1,829,550 A * 10/1931 Symons ..... 248/357
2,331,247 A * 10/1943 Symons ..... 248/357
3,863,878 A * 2/1975 Gregory et al. ..... 248/295.11
4,763,878 A * 8/1988 Abraham et al. ..... 254/100

* cited by examiner

*Primary Examiner*—Michael Safavi
(74) *Attorney, Agent, or Firm*—Kent A. Herink; Daniel A. Rosenberg; Davis Law Firm

(57) ABSTRACT

A U-head plate is provided having a channel for capturing a base plate of a shoring apparatus. A pair of inwardly opposing L-shaped extensions extending downwardly from the U-head plate forms the channel. A latch attached to the U-head plate has a tongue for engaging a notch in the base plate of the shoring apparatus upon capture of the base plate of the shoring apparatus within the channel. The tongue is biased toward the notch by a spring.

14 Claims, 6 Drawing Sheets

ATTACHMENT DEVICE FOR CONCRETE SHORING APPARATUS

BACKGROUND OF THE INVENTION

1. Field of Invention

The present invention relates generally to concrete shoring apparatus used in forming concrete structures and, more specifically, to a latch that can be utilized to rapidly and securely attach U-heads to concrete shore towers.

2. Background of the Prior Art

Concrete forming apparatuses are in wide use in the construction of buildings, bridges, and other concrete structures. The formwork against which the concrete is formed is often held into place by shoring apparatus. In creating shoring apparatus having the desired configuration, it is beneficial to be able to interconnect various components of the shoring apparatus in a wide variety of adjusted positions and to be able to quickly and easily connect, disconnect, and adjust the positions of the components. Further, it is advantageous to have the ability to interconnect the various components of the shoring apparatus in a wide variety of configurations without unduly multiplying the number of distinct components that are required to assemble the shoring apparatus of desired diversity.

Concrete shoring suppliers deliver truckloads of shoring equipment to a customer's job site, to facilitate shipping purposes, the equipment is dissembled. When the shoring equipment arrives at the customer's job site, the customer is then required to assemble the shoring towers prior to use. Thus, to save time and money, it is desirable to have rapid attachment methods during the assembly of the towers.

Previously, a U-head has been attached to shoring posts using a pipe welded to the base of the U-head. This pipe has a drilled hole that permits a pin to secure the head through the shore post. Another method utilized uses a pipe that has a spring pin that secures the U-head to the shore post. These previous methods utilize many loose pieces that must be attached, are easy to lose, and are time consuming to assemble. Accordingly a need exists for the rapid attachment and release of the U-head to the concrete shoring tower.

SUMMARY OF THE INVENTION

An object of the invention comprises providing a device for attaching the U-head to a concrete shoring tower, where the device provides for rapid and secure attachment.

These and other objects of the present invention will become apparent to those skilled in the art upon reference to the following specification, drawings, and claims.

The present invention intends to overcome the difficulties encountered heretofore. To that end, a U-head plate is provided having a channel for capturing a base plate of a shoring apparatus. A latch is attached to the U-head plate and has a tongue for engaging a notch in the base plate of the shoring apparatus, upon capture of the base plate of the shoring apparatus within the channel.

DETAILED DESCRIPTION OF THE INVENTION

Figure 1:
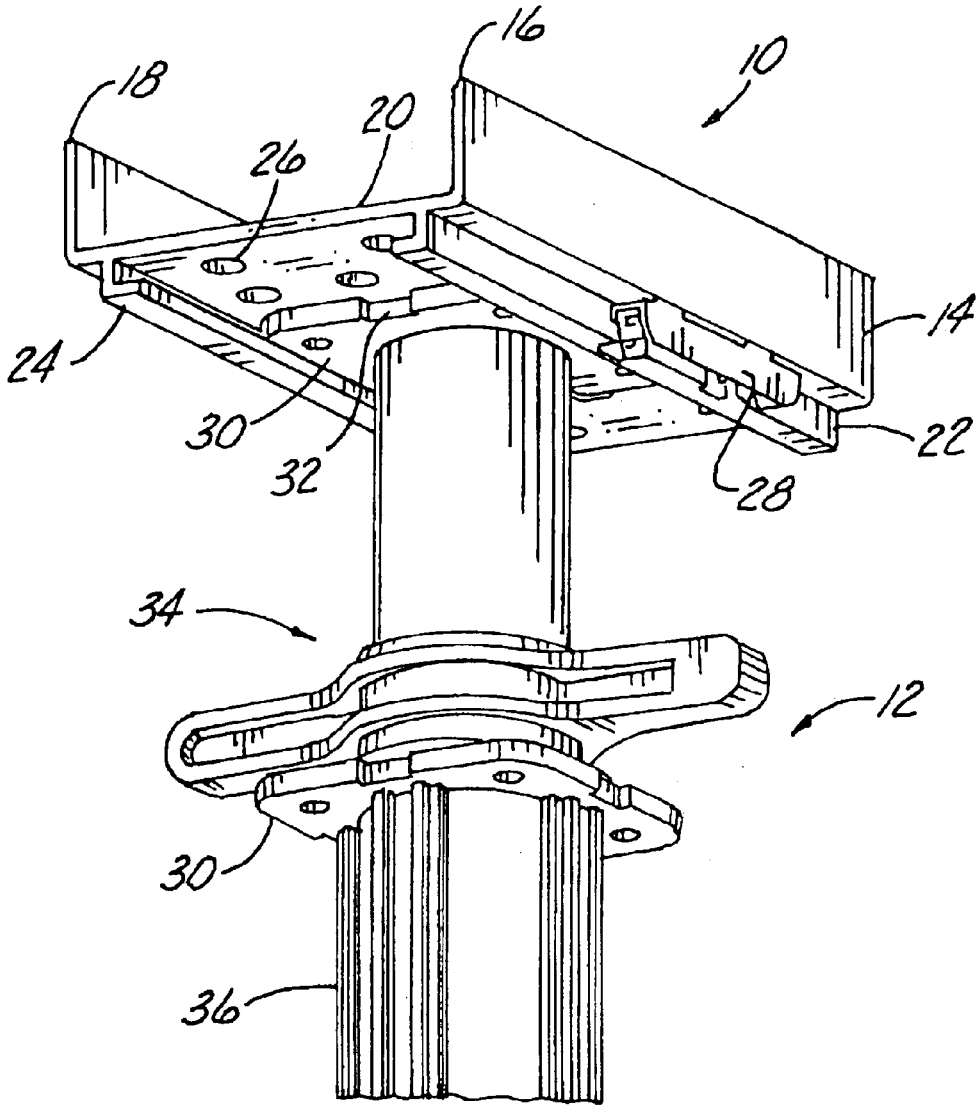
FIG. 1 is a perspective view of a U-head assembly and a shoring apparatus.

In the Figures, FIG. 1 shows a U-head assembly 10 attached to a concrete shoring apparatus 12. The U-head assembly 10 comprises a U-head channel plate 14. The U-head channel plate 14 includes two opposing channel walls 16, 18, a channel base 20 therebetween, and two inwardly opposing L-shaped extensions 22, 24 extending downward from opposite sides of the channel base 20. Holes 26 in the channel base 20 provide for securing beams (not shown) within the U-head assembly 10. A latch 28 is attached to one of the L-shaped extensions 22. Those of ordinary skill in the art will understand that the latch 28 can attach to either extension 22, 24. The U-head plate 14 of the U-head assembly 10 is attached to the shoring apparatus 12 by capturing a base plate 30 of the shoring apparatus 12 within a channel created by the opposing L-shaped extensions 22, 24. The base plate 30 also contains notches 32, centered on each side of the base plate 30. The shoring apparatus 12 also comprises an adjustable jackscrew 34 that is then attached to another identical notched base plate 30 of a shoring post 36. Of course, the U-head assembly 10 can attach to either base plate 30 of the shoring apparatus 12.

Figure 2A:
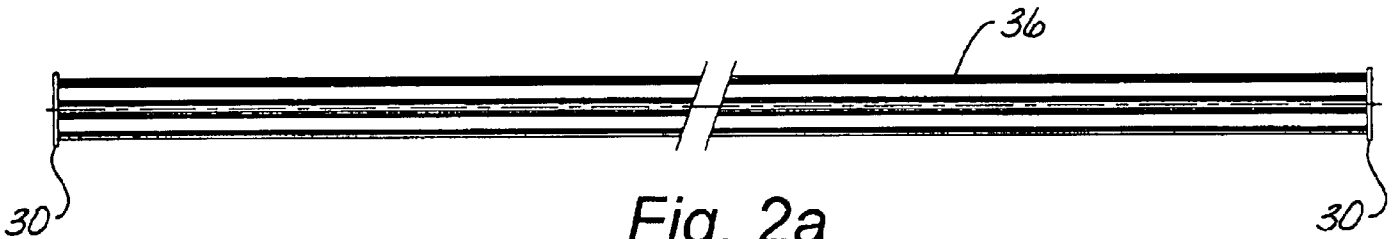
FIG. 2*a* is a side view of a shoring post.
Figure 2B:
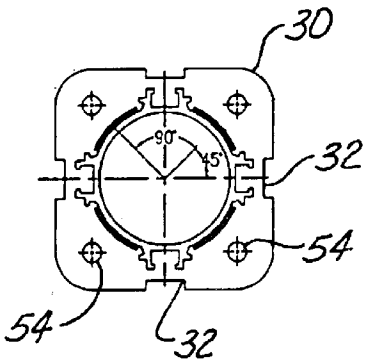
FIG. 2*b* is a cross-sectional end view of the shoring post of FIG. 2*a*, taken along the line A—A in FIG. 2*a*.

For further detail of the shoring apparatus 10, FIG. 2*a* shows a side view of the aluminum shoring post 36, with base plates 30 located on each end. FIG. 2*b* illustrates the cross-sectional end view of the shoring post 36, taken along the line A—A in FIG. 2*a*, detailing the base plate 30, showing the notches 32 centered on each side of the base plate 30.

Figure 4C:
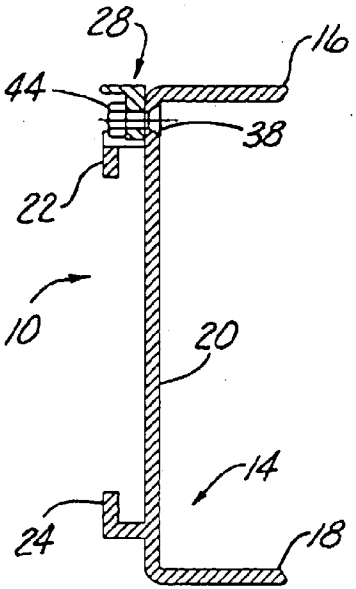
FIG. 4*c* is a cross-sectional view of the U-head assembly, taken along the line A—A in FIG. 4*b*.
Figure 4A:
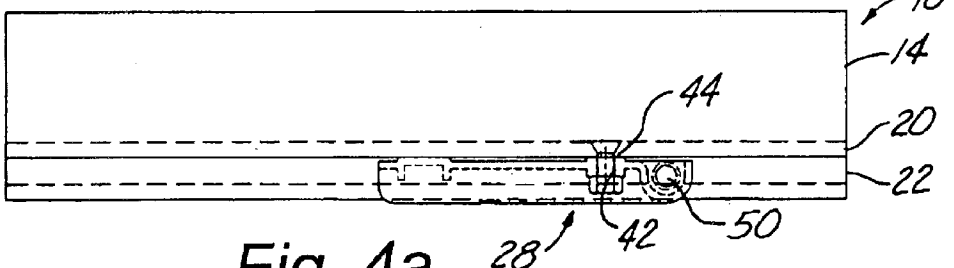
FIG. 4*a* is a side view of the U-head assembly.
Figure 4B:
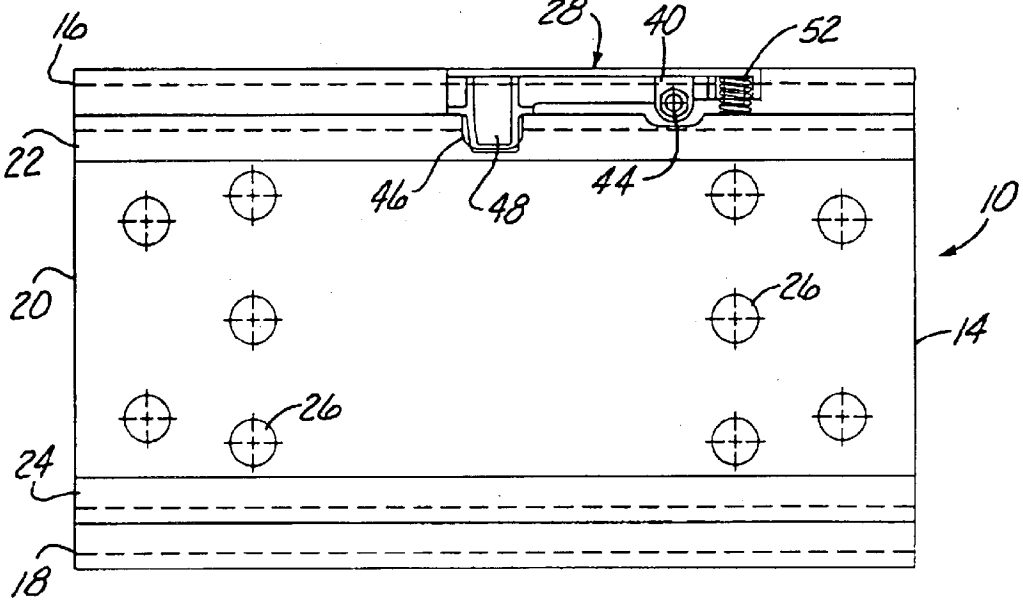
FIG. 4*b* is a bottom view of the U-head assembly.
Figure 5A:
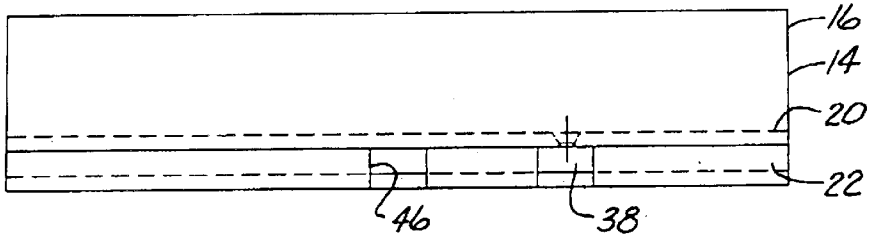
FIG. 5*a* is a side view of a U-head channel plate.
Figure 5B:
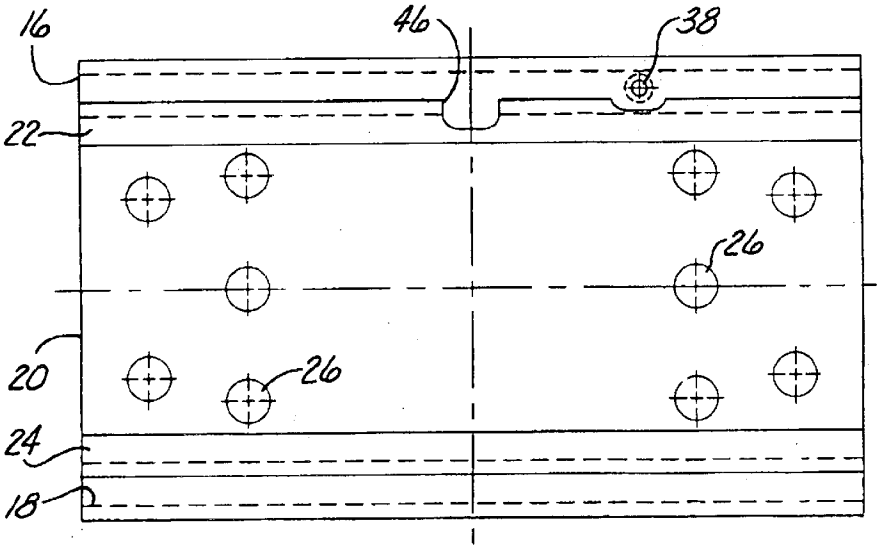
FIG. 5*b* is a bottom view of the U-head channel plate.
Figure 5C:
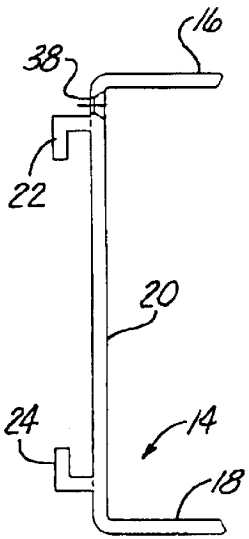
FIG. 5*c* is a cross-sectional view of the U-head channel plate, taken along the line A—A in FIG. 5*b*.
Figure 6:
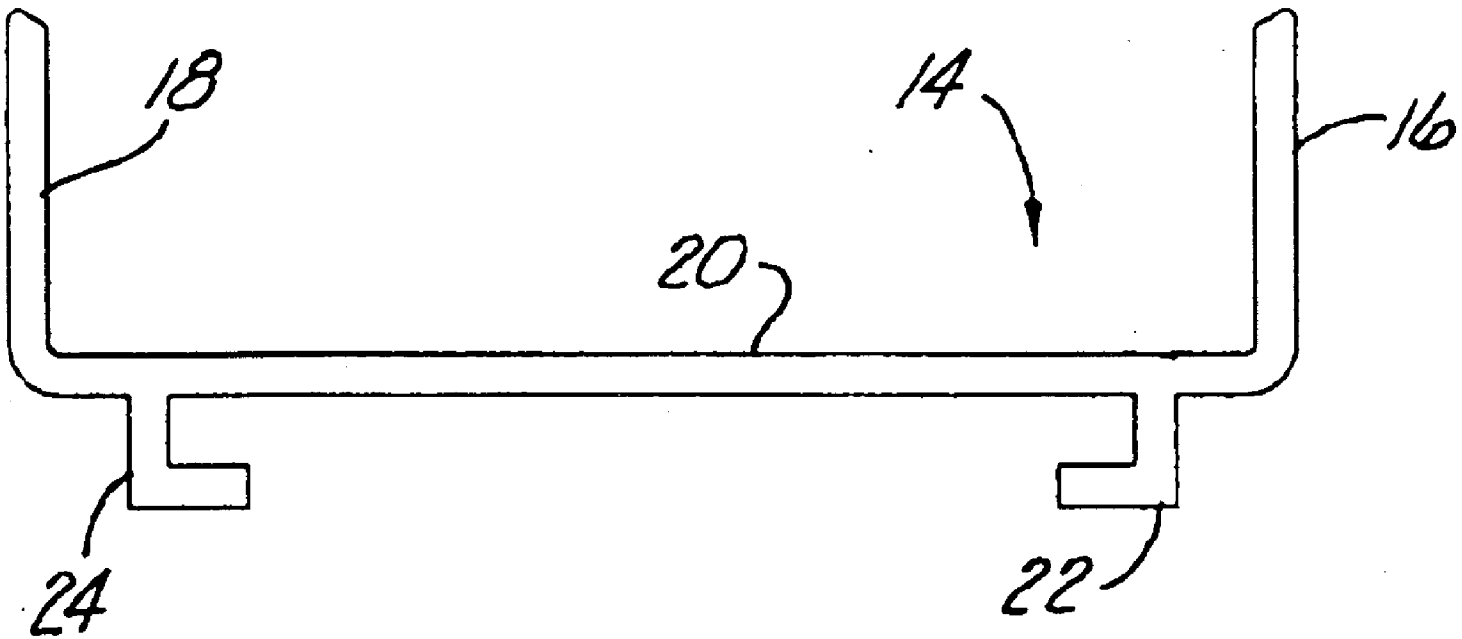
FIG. 6 is an end view of the U-head channel plate.
Figure 7D:
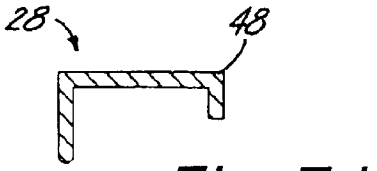
FIG. 7*d* is a cross-sectional view of the latch of the U-head assembly taken along the line A—A shown in FIG. 7*b*.
Figure 7E:
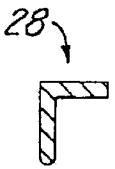
FIG. 7*e* is a cross-sectional view of the latch of the U-head assembly taken along the line B—B shown in FIG. 7*b*.
Figure 7F:
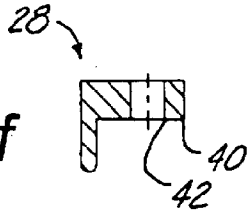
FIG. 7*f* is a cross-sectional view of the latch of the U-head assembly taken along the line C—C shown in FIG. 7*b*.
Figure 7G:
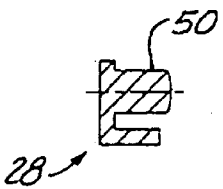
FIG. 7*g* is a cross-sectional view of the latch of the U-head assembly taken the line D—D shown in FIG. 7*b*.
Figure 7A:
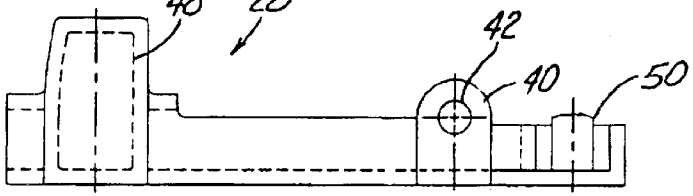
FIG. 7*a* is bottom view of a latch of the U-head assembly.
Figure 7B:
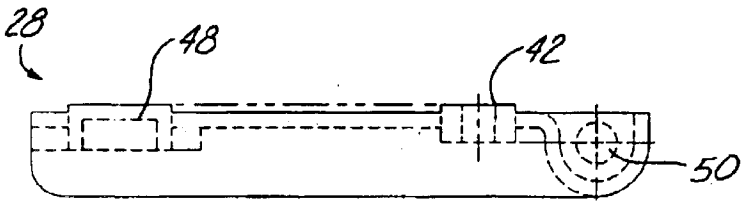
FIG. 7*b* is a side view of the latch of the U-head assembly.
Figure 7C:
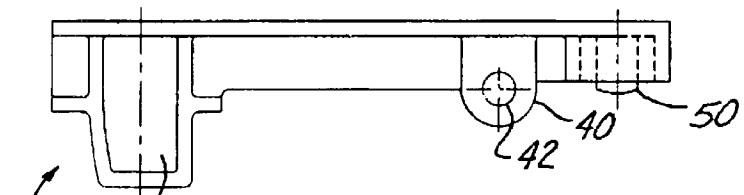
FIG. 7*c* is a top view of the latch of the U-head assembly.

The latch 28 of the U-head assembly 10 attaches to the L-shaped extension 24. Shown best in FIGS. 4*a–c*, the base 20 of the U-head channel plate 14 includes a hole 38 (see also FIGS. 5*a–c*). The hole 38 aligns with a hole 42 in an ear 40 of the latch 28. A nut and bolt combination 44 releaseably secures the latch 28 to the base 20, through the holes 38, 42 in the U-head plate 14 and latch 28. The bolt head of the nut and bolt combination 44 is recessed so as to not interfere with the movement of beams in and out of the U-head assembly 10. The L-shaped extension 22 includes a hole 46 aligned with a tongue 48 of the latch 28 such that the tongue 48 extends into, and through, the hole 46. On the end of the latch 28 opposite to the tongue 48 is a spring post 50 and spring 52 captured on the spring post 50.

The movement of the latch 28, best illustrated in reference to FIGS. 7*a–c* and 4*a–c*, allows the tongue 48 to engage the notch 32 of the base plate 30 under the biasing force of the spring 52. The spring 52 biases the latch 28 such that the tongue 48 of the latch is forced inward through the hole 46 in the L-shaped extension 22. Engaging the U-head assembly 10 with the shoring apparatus 12 is accomplished by slideably moving the U-head assembly 10 onto the base plate 30 such that the channel created by the inwardly opposing L-shaped extensions 22, 24 captures the edges of the base plate 30. The tongue 48 rides along the outside edge of the base plate 30 until the hole 46 in the L-shaped extension 24 approaches the notch 32 in the base plate 30. At this point the spring 52 biases the tongue 48 into the notch 32 thereby engaging the U-head assembly 10 and the shoring apparatus 12. The hole 46 is positioned at the midpoint of the L-shaped extension 24 in order to best balance the U-head assembly 10 on the shoring apparatus 12.

To disengage the U-head assembly 10 merely requires compressing the spring 52 until the tongue 48 disengages from the notch 32 of the base plate 30. The latch 28 pivots about the hole 42 in the ear 40. In other words, pressure applied to the outside of the latch 28 at the end adjacent to the spring 52 will disengage the tongue 48 of the latch 28, thereby allowing for slideably removing the U-head assembly 10 from the base plate 30 of the shoring apparatus 12.

Figure 3:
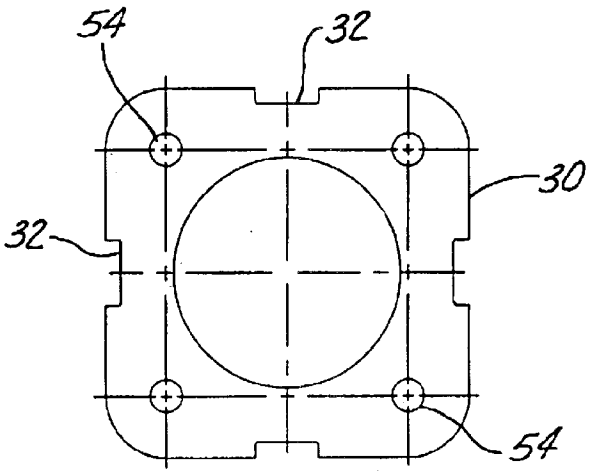
FIG. 3 is an end view of a base plate of the shoring apparatus.

In the preferred embodiment of the invention, the shoring post 36 shown in FIG. 2*a* is measured at a length of 11'5½", with a weight of 41.94 lbs., and is constructed of aluminum. The base plate 30 measures approximately 6" along each side, taking into consideration the rounded edges, and is ⅜" thick. The base plate 30 is affixed to the shoring post 36 with four 1³⁄₁₆" welds equally spaced around the outside of the center diameter of the shoring post 36. The base plate 30 is also constructed of aluminum. The base plate 30, best shown in FIG. 3, includes holes 54 to allow for interconnection of the components of the shoring apparatus 12. The notches 32 in the base plate 30 are centered on each side of the base plate 26 and have an inside width of 1¹⁄₁₆".

The compression spring 52 is measured at a free length of 0.875", with an outside diameter of 0.480" and an inside diameter of 0.354". The spring rate is 65 lbs/inch, with closed and ground ends. The bolt and nut combination 44 is composed of a ¼-20 steel center lock nut with a lock nut with rectangular indentation. The screw for this combination is a ¼-20×⅞" hexagon socket flat countersunk head cap screw.

The U-head channel plate 14 is extruded aluminum and measures 8⅛"×2⅜"×14". The outside of the L-shaped extensions 22, 24 are located on the base 20 of the U-head channel plate 14 inset at a distance of 0.750" from the outside rounded corners. The L-shaped extensions 22, 24 extend down from the U-head channel plate 14 a distance of 0.438"+/−0.014" and corner in at the bottom a length of 1". The length from the outside sharp corner of L-shaped extension 16 to the outside sharp corner L-shaped extension 18 is 6.625". The inside distance from the end of L-shaped extension 16 to L-shaped extension 18 is 5.125"+/−0.044".

The latch 28 has a length of 5³⁄₁₆". The tongue 48 is ⅞" wide at a height of 1⅜ from the base of the latch 28. The compression spring 42 is positioned at a distance of 1" from the center of the bolt and nut combination 44. At this length, the latch 28 has a height of ½", which then increases to ⁹⁄₁₆" at the center of the bolt and nut combination 44. The height of the lever latch 28 stays at ½" until it increases to ¾" at a distance of approximately 2⁵⁄₁₆" from the inside edge of the bolt and nut combination 44, then it is at a height of ¾" for a distance of ¼", when it then raises to the top height of 1⅜", where it is notched for ⅞" before returning to the height of ¾" until the end of the latch 28.

The U-head assembly 10 allows for quick and easy assembly. It utilizes a minimum of moving parts, and eliminates the need for any lose parts. The assembly 10 does not require any special tools to attach or remove the assembly 10 from the shoring apparatus 12. The latch 28 is easy to operate due to the fact that it self engages with the notch 32 of the base plate 30, and disengages with a reasonable amount of pressure. In this manner, the assembly substantially reduces, or eliminates the problems associated with prior art assemblies.

The foregoing description and drawings comprise an illustrative embodiment of the present invention. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. It is anticipated that those of ordinary skill in the art with this disclosure before them will be able to make modifications in variations therein without departing from the scope of the invention.

What is claimed is:

1. A shoring assembly with a U-head assembly for rapid and secure attachment to a notched plate of a shoring post, said shoring assembly comprising:

a U-head plate having a first wall and a second wall extending generally upward with a base therebetween;

a support assembly with a notched plate;

said U-head plate having first and second L-shaped inwardly opposing extensions extending downwardly from said base thereby forming a channel adapted for slidably capturing the notched plate of the support assembly in a direction perpendicular to the support assembly;

a latch attached to one of said extensions of said U-head plate, said latch having a tongue for engaging the notch of the support assembly plate through a hole in one of said extensions upon capture of the notched plate of the support assembly within said channel, wherein said latch further comprises a spring biasing said tongue toward the notch of the base plate of the support assembly and compression of said spring disengages said tongue from the notch of the base plate of the support assembly; and the latch providing for hand releasable attachment and sliding removal perpendicular to the support assembly of the U-head plate from the notched plate of the support assembly.

2. A U-head assembly for rapid and secure attachment to a notched base plate of shoring post apparatus, said assembly comprising:

a U-head plate having two inwardly opposing L-shaped extensions that form a channel formed by first and second extensions and received in sliding engagement perpendicular to the shoring post on the base plate of the shoring apparatus, a latch attached to one of said extensions of said U-head plate, said latch having a tongue for engaging the notch in the base plate of the shoring post apparatus upon sliding engagement of the base plate of the shoring apparatus within said channel; and the latch providing for hand releasable attachment and sliding removal perpendicular to the shoring post of the U-head plate from the base plate.

3. The invention in accordance with claim 1 wherein said extensions are L-shaped and inwardly opposing thereby forming a C-shaped channel for capturing the base plate of the shoring apparatus.

4. The invention in accordance with claim 1 wherein said tongue of said latch engages notch of the base plate of the shoring post apparatus through a hole in one of said extensions.

5. The invention in accordance with claim 4 wherein said U-head plate further comprises a first wall and a second wall with a base therebetween, and said extensions extend downwardly from said base of said U-head plate opposite the first and second wall.

6. A U-head assembly for rapid and secure attachment to a notched base plate of shoring post apparatus, said assembly comprising:

a U-head plate having two inwardly opposing L-shaped extensions that form a channel received in sliding engagement perpendicular to the shoring post on the base plate of the shoring apparatus, a latch attached to said U-head plate, said latch having a tongue for engaging the notch in the base plate of the shoring post apparatus upon sliding engagement of the base plate of the shoring apparatus within said channel; and the latch providing for hand releasable attachment and sliding removal perpendicular to the shoring post of the U-head plate from the base plate, and wherein said latch further comprises a spring for biasing said tongue toward the notch of the base plate of the shoring apparatus.

7. The invention in accordance with claim 6 wherein said tongue of said latch is disengaged from the notch of the base plate of the shoring apparatus by compressing said spring.

8. A U-head assembly for rapid and secure attachment to a notched base plate of shoring post apparatus, said assembly comprising:

a U-head plate having a first wall and a second wall extending generally upward with a base therebetween, and first and second L-shaped inwardly opposing extensions extending downwardly from said base thereby forming a channel adapted for slidably capturing the base plate of the shoring post apparatus in a direction perpendicular to the shoring post;

a latch attached to one of said extensions of said U-head plate, said latch having a tongue for engaging the notch of the base plate through a hole in one of said extensions upon capture of the base plate of the shoring apparatus within said channel, wherein said latch further comprises a spring biasing said tongue toward the notch of the base plate of the shoring post apparatus and compression of said spring disengages said tongue from the notch of the base plate of the shoring post apparatus; and the latch providing for hand releasable attachment and sliding removal perpendicular to the shoring post of the U-head plate from the base plate.

9. An apparatus for use in shoring comprising:

a U-head plate;

a support assembly having a notched base plate;

the U-head plate having two inwardly opposing L-shaped extensions that form a channel formed by first and second extensions and received in sliding engagement perpendicular to the support assembly on the base plate of the support assembly;

a latch attached to one of said extensions of said U-head plate, said latch having a tongue for engaging the notch in the base plate of the support assembly upon sliding engagement of the base plate of the support assembly within said channel; and the latch providing for hand releasable attachment and sliding removal perpendicular to the support assembly of the U-head plate from the base plate.

10. The invention in accordance with claim 9 wherein said extensions are L-shaped and inwardly opposing thereby forming a C-shape channel for capturing the base plate of the support assembly.

11. The invention in accordance with claim 9 wherein said tongue of said latch engages notch of the base plate of the support assembly through a hole in one of said extensions.

12. The invention in accordance with claim 11 wherein said U-head plate further comprises a first wall and a second wall with a base therebetween, and said extensions extend downwardly from said base of said U-head plate opposite the first and second wall.

13. An apparatus for use in shoring comprising:

a U-head plate;

a support assembly having a notched base plate;

the U-head elate having two inwardly opposing L-shaped extension that form a channel received in sliding engagement perpendicular to the support assembly on the base plate of the support assembly;

a latch attached to said U-head plate, said latch having a tongue for engaging the notch in the base plate of the support assembly upon sliding engagement of the base plate of the support assembly within said channel; and the latch providing for hand releasable attachment and sliding removal perpendicular to the support assembly of the U-head plate from the base plate and wherein said latch further comprises a spring for biasing said tongue toward the notch of the base plate of the support assembly.

14. The invention in accordance with claim 13 wherein said tongue of said latch is disengaged from the notch of the base plate of the support assembly by compressing said spring.

* * * * *